US006798147B2

(12) United States Patent
Yang

(10) Patent No.: US 6,798,147 B2
(45) Date of Patent: Sep. 28, 2004

(54) [DRIVING CIRCUIT OF DISPLAY DEVICE]

(75) Inventor: Chien-Sheng Yang, Taipei (TW)

(73) Assignee: Au Optronics Corporation, Hsinchu (TW)

( * ) Notice: Subject to any disclaimer, the term of this patent is extended or adjusted under 35 U.S.C. 154(b) by 0 days.

(21) Appl. No.: 10/604,043

(22) Filed: Jun. 24, 2003

(65) Prior Publication Data

US 2004/0000876 A1 Jan. 1, 2004

(30) Foreign Application Priority Data

Jun. 28, 2002 (TW) ..... 91114290 A

(51) Int. Cl.[7] ..... G09G 3/10; G09G 3/34
(52) U.S. Cl. ..... 315/169.1; 345/84
(58) Field of Search ..... 315/169.1, 169.3, 315/204, 214, 169.2, 82; 345/84

(56) References Cited

U.S. PATENT DOCUMENTS 6,677,713 B1 * 1/2004 Sung ..... 315/169.1
2002/0097350 A1 * 7/2002 Haven et al. ..... 349/43
2002/0118150 A1 * 8/2002 Kwon ..... 345/76
2003/0107560 A1 * 6/2003 Yumoto et al. ..... 345/204
2003/0179166 A1 * 9/2003 Li ..... 345/84
2004/0000876 A1 * 1/2004 Yang ..... 315/169.1

* cited by examiner

*Primary Examiner*—Don Wong
*Assistant Examiner*—Chuc Tran
(74) *Attorney, Agent, or Firm*—Jiang Chyun IP Office

(57) ABSTRACT

A driving circuit for a display device. The driving circuit serves to drive a light-emitting device. The driving circuit includes a biasing device, a switching transistor, a capacitor and a voltage coupler. This invention incorporates a biasing device to each data line so that the voltage at each end of the biasing device resulting from a flow of the data current through the device is fed to the switching transistor. The voltage at each end of the biasing device is transmitted without attenuation to the terminals of the biasing device through a voltage coupler. Since the voltage at two ends of the light emitting device and the voltage at two ends of the biasing device are identical, the driving current flowing through the light emitting device and the data current are identical.

18 Claims, 4 Drawing Sheets

[DRIVING CIRCUIT OF DISPLAY DEVICE]

CROSS REFERENCE TO RELATED APPLICATIONS

This application claims the priority benefit of Taiwan application serial no. 91114290, filed Jun. 28, 2002.

BACKGROUND OF INVENTION

1. Field of Invention

The present invention relates to a display device. More particularly, the present invention relates to the driving circuit of a display device.

2. Description of Related Art

Dynamic recording of documentary through film has a long history. With the invention of cathode ray tube (CTR) and broadcasting equipment, television has become an indispensable electronic device in almost every family. In the electronic industry, CRTs are also used as monitors for desktop computers. However, the CRT is now gradually being phased out due to radiation hazards and bulkiness of the CRT body that needs to house an electron gun.

Because of radiation hazards and bulkiness, flat panel displays have been developed. The types of flat panel displays now include liquid crystal display (LCD), field emission display (FED), organic light emitting diode (OLED) and plasma display panel (PDP).

Organic light emitting diode (OLED) is sometimes referred to as organic electroluminescence display (OELD). OLED is a type of self-illuminating device arranged to form a matrix of points. Each OLED is driven by a low DC current to produce light having a high luminance and contrast. The OLED also has a high operating efficiency and carries very little weight. Moreover, the OLED may emit light within a range of colors including the three primary colors red (R), green (G), blue (B) and white light. Consequently, OLED is currently the most actively developed type of flat panel display. Aside from high-resolution, lightweight, active illumination, quick response and energy saving capacity, the advantages of OLED further include a large viewing angle, good color contrast and low production cost. Currently, the OLED has many applications such as a light source at the back of a LCD or indicator panel in a mobile phone, a digital camera, a personal digital assistant (PDA) and so on.

According to the driving method, OLED may be classified into two major types, namely, a passive matrix driven type and an active matrix driven type. The passive matrix driven OLED has a simpler structure and does not use any thin film transistor (TFT). Hence, the passive matrix driven OLED is easier and less expensive to produce. However, the passive matrix driven OLED has a lower resolution and consumes a lot of electrical energy if the display area is large. On the other hand, the active matrix driven OLED is suitable for fabricating large display panels. The active matrix driven OLED panel has a wide viewing angle, illuminates brightly and responds quickly to control signals. Nevertheless, the active matrix driven OLED panel is slightly more expensive to produce.

According to the driving mode, flat panel displays may be further categorized as a voltage driven type or a current driven type. The voltage driven mode is commonly employed in a thin film transistor liquid crystal display (TFT-LCD). To produce different gray scale colors and hence a full coloration in a voltage driven TFT-LCD, different voltages are fed to respective data lines. On the other hand, the current-driven design is often employed in OLED display device. To produce different gray scale colors and hence a full coloration in a current-driven OLED display, different currents are fed to data lines.

FIG. 1 is an equivalent circuit diagram of one of the pixels inside a conventional AM-OLED display device. As shown in FIG. 1, the pixel 10 includes a driving circuit 102 and an organic light emitting diode (OLED) 104. The driving circuit 102 further includes a first thin film transistor (TFT1) 106, a capacitor (C) 108, a second thin film transistor (TFT2) 110, a third thin film transistor (TFT3) 112 and a fourth thin film transistor (TFT4) 114. The second transistor (TFT2) 110 is a driving thin film transistor that generates a driving current to light up the OLED 104. The gate of the fourth transistor (TFT4) 114 is coupled to the gate terminal of the third transistor (TFT3) 112 and a scanning voltage (Vscan). The drain terminal of the fourth transistor (TFT4) 114 is coupled to the drain terminal of the third transistor (TFT3) 112 and the drain terminal of the first transistor (TFT1) 106. The source terminal of the fourth transistor (TFT4) 114 is coupled to a terminal for receiving a data current (I). The source terminal of the third transistor (TFT3) 112 is coupled to one end of the capacitor (C) 108, the gate terminal of the first transistor (TFT1) 106 and the gate terminal of the second transistor (TFT2) 110. The source terminal of the first transistor (TFT1) 106 is coupled to the other terminal of the capacitor (C) 108, the source terminal of the second transistor (TFT2) 110 and a positive voltage terminal ($V_{DD}$). The drain terminal of the second transistor (TFT2) 110 is coupled to the positive terminal of the OLED 104. The negative terminal of the OLED is connected to ground. According to FIG. 1, the driving circuit 102 has a current mirror structure. In other words, the driving current flowing through the second transistor (TFT2) 110 is determined by the data current (I). However, because of non-ideal voltage-current properties of a transistor, the driving current flowing through the second transistor (TFT2) 110 may differ from the data current (I). This may lead to the generation of an incorrect driving current and a variation of the OLED 104 luminance.

SUMMARY OF INVENTION

Accordingly, one object of the present invention is to provide a driving circuit for display devices. The design includes adding a biasing device to each data line. The voltage at each end of the biasing device resulting from a flow of the data current through the device is fed to a switching transistor. The voltage at each end of a light-emitting device reproduces the voltage at each end of the biasing device through a voltage coupler. Since the voltage measured at two ends of the light emitting device and the voltage measured at two ends of the biasing device are identical, the driving current flowing through the light emitting device and the data current are identical.

To achieve these and other advantages and in accordance with the purpose of the invention, as embodied and broadly described herein, the invention provides a driving circuit for display devices. The driving circuit drives a light-emitting device. The light-emitting device has a positive terminal and a negative terminal. The driving circuit includes a biasing device, a switching transistor, a capacitor and a voltage coupler. The biasing device has a first terminal point and a second terminal point. The first terminal point is connected to a terminal for receiving a data current while the second terminal point is connected to ground. The switching transistor has a first drain terminal, a first gate terminal and a first drain terminal. The first drain terminal is connected to the first terminal point and the first gate terminal is connected to a scanning line. The capacitor has a third terminal point and a fourth terminal point. The third terminal point is connected to the first source terminal and the fourth terminal point is connected to ground. The voltage coupler has an input terminal and an output terminal. The input terminal is connected to the first source terminal and the third terminal point and the output terminal is connected to the light-emitting device.

In one embodiment of this invention, the biasing device is an organic light emitting diode. The voltage coupler includes a driving transistor. The driving transistor has a second drain terminal, an input terminal and an output terminal. The second drain terminal is connected to a power supply. The power supply provides a voltage ($V_{DD}$). The driving transistor is an N-type thin film transistor or a P-type thin film transistor. The light-emitting device is an organic light emitting diode or a high molecular weight light emitting diode. The switching transistor is an N-type thin film transistor or a P-type thin film transistor.

This invention also provides a display device that includes a plurality of pixels. Each pixel includes a switching transistor, a capacitor, a voltage coupler and a light-emitting device. The switching transistor has a first drain terminal, a first gate terminal and a first source terminal. The first drain terminal is connected to the biasing device and the first gate terminal is connected to a scanning line. The capacitor has a first terminal point and a second terminal point. The first terminal point is connected to the first source terminal and the second terminal point is connected to ground. The voltage coupler has an input terminal and an output terminal. The input terminal is connected to the first source terminal and the first terminal point. The light-emitting device has a positive terminal and a negative terminal. The positive terminal is connected to the output terminal while the negative terminal is connected to ground. The biasing device has a third terminal point and a fourth terminal point. The third terminal point is connected to a terminal for receiving data current and the first drain terminal. The fourth terminal point is connected to ground.

In brief, this invention incorporates a biasing device to each data line. The voltage at each end of the biasing device resulting from a flow of the data current through the device is fed to a switching transistor. The voltage at each end of the biasing device is transmitted without attenuation to the terminals of the light-emitting device through a voltage coupler. Since the voltage at two ends of the light-emitting device and the voltage at the terminals of the biasing device are identical, the driving current flowing through the light emitting device and the data current are identical.

It is to be understood that both the foregoing general description and the following detailed description are exemplary, and are intended to provide further explanation of the invention as claimed.

BRIEF DESCRIPTION OF DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION

Figure 1:
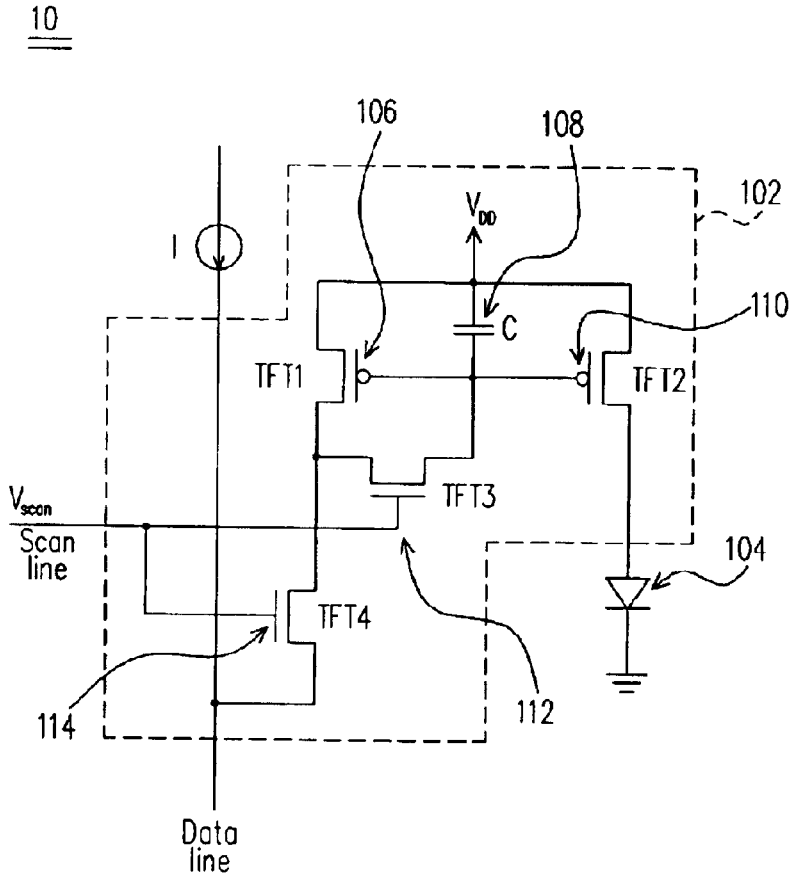
FIG. 1 (PRIOR ART)
FIG. 1 is an equivalent circuit diagram of one of the pixels inside a conventional AM-OLED display device.

Reference will now be made in detail to the present preferred embodiments of the invention, examples of which are illustrated in the accompanying drawings. Wherever possible, the same reference numbers are used in the drawings and the description to refer to the same or like parts.

Figure 2:
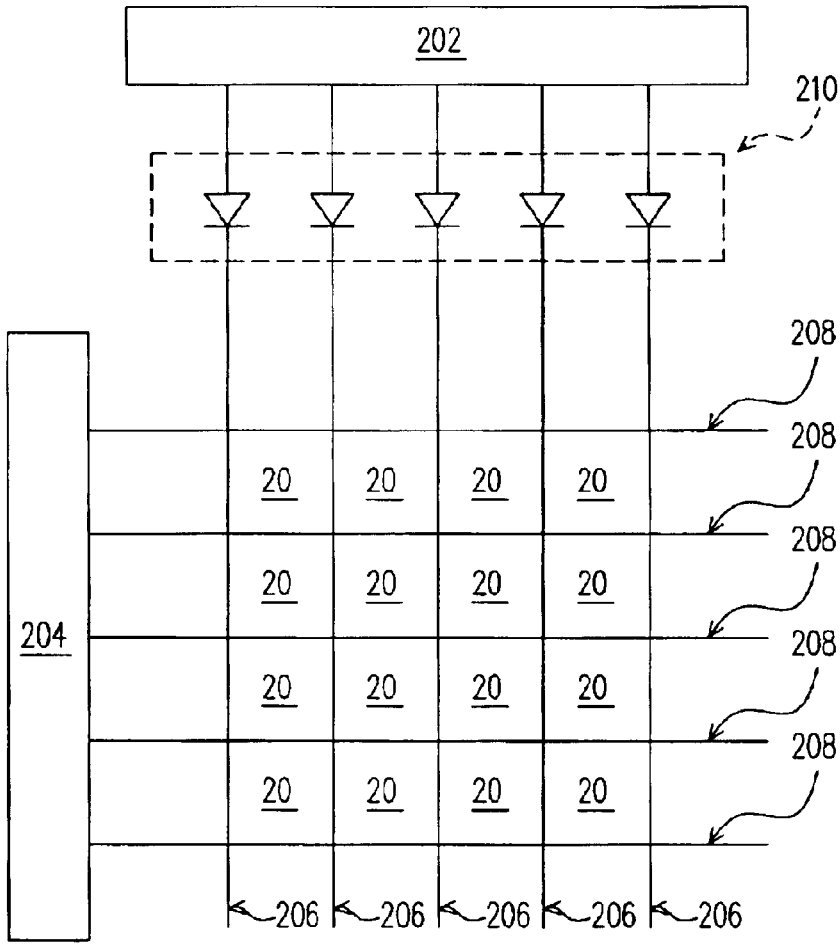
FIG. 2 is a schematic diagram showing the driving circuit of a display device according to one preferred embodiment of this invention.

FIG. 2 is a schematic diagram showing the driving circuit of a display device according to one preferred embodiment of this invention. The driving circuit has an array structure. The driving circuit includes a data driver 202, a scanning driver 204, a data line 206, a scanning line 208 and a biasing device 210. In general, the biasing device is an organic light emitting diode (OLED). Each biasing device 210 is attached to a data line 206. In this embodiment, one of the data lines 206 together with one of the scanning lines 208 forms a pixel 20. The data driver 202 provides a data current to the biasing device 210. Voltages at the two terminals of a biasing device 210 are transmitted to a pixel 20. The scanning driver 204 provides a voltage to each scanning line 208.

Figure 3:
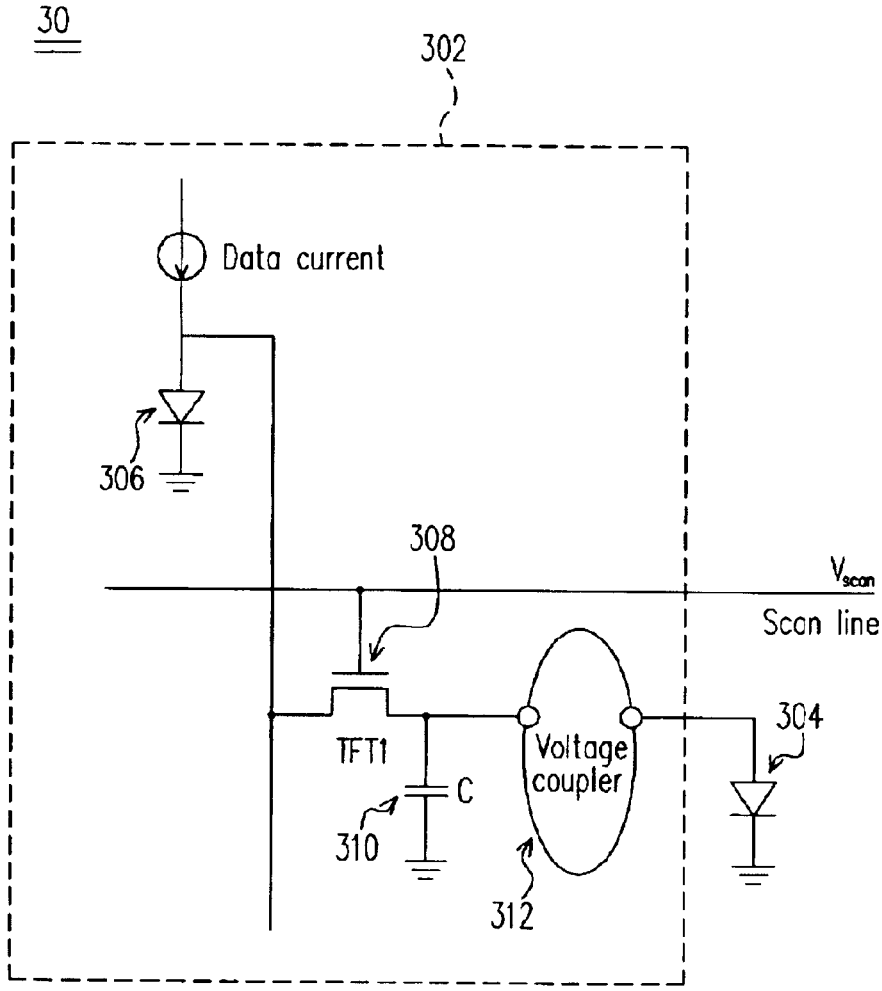
FIG. 3 is an equivalent circuit diagram of one of the pixel driving circuits inside a display device according to one preferred embodiment of this invention.

FIG. 3 is an equivalent circuit diagram of one of the pixel driving circuits inside a display device according to one preferred embodiment of this invention. As shown in FIG. 3, the pixel 30 includes a driving circuit 302 and a light-emitting device 304. The light-emitting device 304 can be an OLED or a high molecular weight light emitting diode. The driving circuit 302 further includes a biasing device 306, a transistor (TFT1) 308, a capacitor (C) 310 and a voltage coupler 312. The biasing device 306 can be an OLED. The transistor (TFT1) 308 can be N-type thin film transistor or P-type thin film transistor. The transistor (TFT1) 308 functions as a switching transistor.

The biasing device 306 has two terminals. The transistor (TFT1) 308 has a drain terminal, a gate terminal and a source terminal. The capacitor (C) 310 has two terminals. The voltage coupler 312 has an input terminal and an output terminal. The light-emitting device 304 has a positive terminal and a negative terminal. One terminal (the positive electrode) of the biasing device 306 is coupled to a terminal for receiving a data current and the drain terminal of the transistor (TFT1) 308. The other terminal (the negative electrode) of the biasing device 306 is connected to ground. The gate terminal of the transistor (TFT1) 308 is coupled to a scanning voltage (Vscan). The source terminal of the transistor (TFT1) 308 is coupled to one terminal of the capacitor (C) 310 and the input terminal of the voltage coupler 312. The other terminal of the capacitor (C) 310 is connected to ground. The output terminal of the voltage coupler 312 is coupled to the positive terminal of the light-emitting device 304. The negative terminal of the light-emitting device 304 is connected to ground.

Figure 4:
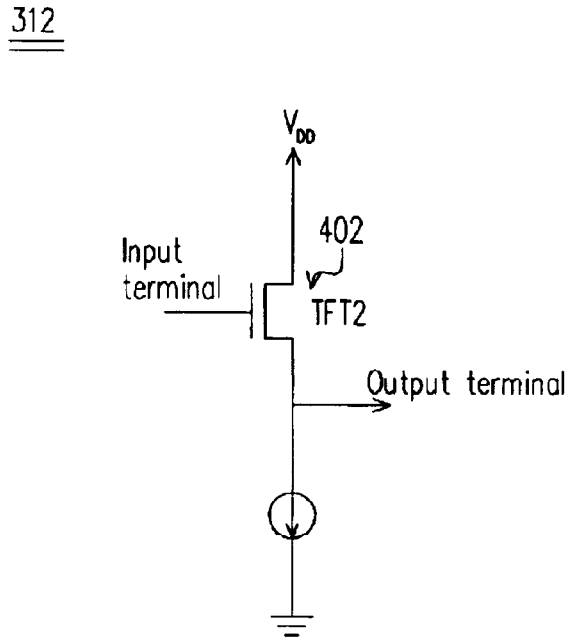
FIG. 4 is a circuit diagram of one type of voltage coupler for the circuit in FIG. 3.

The voltage coupler 312 may have a variety of combinations. FIG. 4 is a circuit diagram of one type of voltage coupler for the circuit in FIG. 3. The voltage coupler 312 in FIG. 3 is constructed using a transistor (TFT2) 402. The transistor (TFT2) 402 can be an N-type thin film transistor or a P-type thin film transistor. The transistor (TFT2) 402 functions as a driving transistor. The transistor (TFT2) 402 has a drain terminal, an input terminal (the gate terminal) and an output terminal (the source terminal). The drain terminal of the transistor (TFT2) 402 is coupled to a power supply that provides a positive voltage $V_{DD}$.

The following is a description of the operation of the pixel 30. For a data line, data current provided by a data driver flows through the biasing device 306 so that the two terminals of the biasing device 306 will receive a bias voltage value. When the scanning voltage (Vscan) is set to a high voltage level, the voltage (Vgst) between the gate terminal and the source terminal of the transistor (TFT1) 308 is greater than the threshold voltage of the transistor (TFT1) 308. Hence, the transistor (TFT1) 308 is conductive. The biased voltage value at the two terminals of the biasing device 306 is transmitted to the output terminal of the voltage coupler 312 through the input terminal of the voltage coupler 312. Since the output voltage and the input voltage of the voltage coupler 312 are identical, the output terminal of the voltage coupler 312 outputs the biased voltage value. The biased voltage value is applied to the positive terminal of the light-emitting device 304. Thus, voltage between the two terminals of the light-emitting device 304 is identical to the biased voltage value. Because voltage at the terminals of the light-emitting device 304 and the biased voltage value are identical, the driving current passing the light-emitting device 304 is identical to the data current. Therefore, data current directly controls the driving current of the light-emitting device 304 so that luminance of the light-emitting device 304 will not deviate too much from the standard value.

In conclusion, this invention incorporates a biasing device to each data line and feeds the voltages at the two terminals that result from a flow of the data current to a switching transistor. The voltage at the terminals of the biasing device is transmitted without attenuation to the terminals of the light-emitting device through a voltage coupler. Since the voltage at the terminals of the light emitting device and at the terminals of the biasing device are identical, the driving current flowing through the light emitting device and the data current are identical.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A driving circuit for driving a light-emitting device inside a display device, wherein the light-emitting device has a positive terminal and a negative terminal, the driving circuit comprising:

a biasing device having a first terminal point and a second terminal point, wherein the first terminal point is connected to a terminal for receiving a data current and the second terminal point is connected to a ground;

a switching transistor having a first drain terminal, a first gate terminal and a first source terminal, wherein the first drain terminal is connected to the first terminal point and the first gate terminal is connected to a scan line;

a capacitor having a third terminal point and a fourth terminal point, wherein the third terminal point is connected to the first source terminal and the fourth terminal point is connected to the ground;

a voltage coupler having an input terminal and an output terminal, wherein the input terminal is connected to the first source terminal and the third terminal point whereas the output terminal is connected to the light-emitting device.

2. The driving circuit of claim 1, wherein the biasing device is an organic light emitting diode.

3. The driving circuit of claim 1, wherein the voltage coupler includes a driving transistor having a second drain terminal in addition to the input terminal and the output terminal and the second drain terminal is connected to a power supply that provides a voltage ($V_{DD}$).

4. The driving circuit of claim 3, wherein the driving transistor is an N-type thin film transistor.

5. The driving circuit of claim 3, wherein the driving transistor is a P-type thin film transistor.

6. The driving circuit of claim 1, wherein the light-emitting device is an organic light-emitting diode.

7. The driving circuit of claim 1, wherein the light-emitting device is a high molecular weight light-emitting diode.

8. The driving circuit of claim 1, wherein the switching transistor is an N-type thin film transistor.

9. The driving circuit of claim 1, wherein the switching transistor is a P-type thin film transistor.

10. A display device having a plurality of pixels with each pixel comprising:

a switching transistor having a first drain terminal, a first gate terminal and a first source terminal, wherein the first drain terminal is connected to a biasing device and the first gate terminal is connected to a scan line;

a capacitor having a first terminal point and a second terminal point, wherein the first terminal point is connected to the first source terminal and the second terminal point is connected to a ground;

a voltage coupler having an input terminal and an output terminal, wherein the input terminal is connected to the first source terminal and the first terminal point; and a light-emitting device having a positive terminal and a negative terminal, wherein the positive terminal is connected to the output terminal and the negative terminal is connected to the ground;

wherein the biasing device has a third terminal point and a fourth terminal point, the third terminal point is connected to a terminal for receiving a data current and the first drain terminal, and the fourth terminal point is connected to the ground.

11. The driving circuit of claim 10, wherein the biasing device is an organic light emitting diode.

12. The driving circuit of claim 10, wherein the voltage coupler includes a driving transistor having a second drain terminal in addition to the input terminal and the output terminal and the second drain terminal is connected to a power supply that provides a voltage ($V_{DD}$).

13. The driving circuit of claim 12, wherein the driving transistor is an N-type thin film transistor.

14. The driving circuit of claim 12, wherein the driving transistor is a P-type thin film transistor.

15. The driving circuit of claim 10, wherein the light-emitting device is an organic light-emitting diode.

16. The driving circuit of claim 10, wherein the light-emitting device is a high molecular weight light-emitting diode.

17. The driving circuit of claim 10, wherein the switching transistor is an N-type thin film transistor.

18. The driving circuit of claim 10, wherein the switching transistor is a P-type thin film transistor.

* * * * *